US006032014A

United States Patent [19]

Janssens et al.

[11] Patent Number: 6,032,014

[45] Date of Patent: Feb. 29, 2000

[54] METHOD OF USING AN IMAGE FORMING APPARATUS

[75] Inventors: Robert Frans Louisa Janssens, Geel; Luc Karel Maria Van Aken, Hasselt; William Constant Maria Waterschoot, Belsele, all of Belgium

[73] Assignee: Xeikon NV, Belgium

[21] Appl. No.: 09/337,277

[22] Filed: Jun. 22, 1999

[30] Foreign Application Priority Data

Jul. 14, 1998 [EP] European Pat. Off. ..... 98305581

[51] Int. Cl.[7] ..... G03G 15/09; G03G 15/00

[52] U.S. Cl. ..... 399/270; 399/162; 399/164; 399/267

[58] Field of Search ..... 399/365, 367, 399/270, 279, 285, 239, 240, 162, 164; 347/55

[56] References Cited

U.S. PATENT DOCUMENTS

| | | | |
|---|---|---|---|
| 4,068,622 | 1/1978 | Vola | 399/279 X |
| 4,433,041 | 2/1984 | Yamashita | 399/270 X |
| 5,168,318 | 12/1992 | Haneda et al. | 399/164 |
| 5,204,696 | 4/1993 | Schmidlin et al. | 347/55 |
| 5,314,774 | 5/1994 | Camis . | |
| 5,652,648 | 7/1997 | Behe et al. | 399/164 |
| 5,832,350 | 11/1998 | Kumasaka et al. | 399/285 X |

FOREIGN PATENT DOCUMENTS

| | | |
|---|---|---|
| 0 424 137 A2 | 4/1991 | European Pat. Off. . |
| 0 625 734 A1 | 11/1994 | European Pat. Off. . |
| 0 871 074 A1 | 10/1998 | European Pat. Off. . |
| 98/07073 | 2/1998 | WIPO . |

OTHER PUBLICATIONS

Patent Abstracts of Japan, Vol. 010, no. 009 (P–420), 14 Jan. 1986 & JP 60–164778 A (Matsushita Denki Sangyo KK), 27 Aug. 1985 *Abstract*.

*Primary Examiner*—S. Lee
*Attorney, Agent, or Firm*—Larson & Taylor

[57] ABSTRACT

A plurality of electrostatic images are formed on a moving tensioned belt formed with an electrically conductive base having a non-conductive image-carrying surface layer. The images are developed by passing the belt through toner development stations, each of which includes a development unit including a magnetic roller and a backing member, in opposed position to the magnetic roller, over which the belt passes. Under non-ideal conditions, the image quality in terms of image density and uniformity of image density and rendition of sharp image transitions, is substantially improved by applying an alternating electrical field between the magnetic roller and the belt, with a peak-to-peak voltage greater than 800 volts.

5 Claims, 4 Drawing Sheets

METHOD OF USING AN IMAGE FORMING APPARATUS

FIELD OF THE INVENTION

The present invention relates to a method of using an image forming apparatus, such as a copier, printer or the like, in which an electrostatic image is formed on an image forming member, from which it is subsequently transferred, directly or indirectly to a substrate.

BACKGROUND TO THE INVENTION

In a typical image forming apparatus, an electrostatic image is formed on an image forming member, which may for example be the surface of a rotating drum or of a tensioned moving belt. This invention is concerned with that form of apparatus in which the image forming member is a belt. The belt usually comprises an electrically conductive base having a non-conductive image-carrying surface layer, which is usually a photoconductive surface. The electrostatic image is, for example, formed by charging the photoconductive surface to a first potential, known as the "dark" potential, and then image-wise exposing the charged photoconductor surface to dissipate the charge on image areas.

The electrostatic image is brought into the vicinity of a toner developing device, which is supplied with developer, typically a mixture of a particulate toner and magnetic carrier particles. The electrostatic image is developed by passing the belt in the vicinity of the toner development unit. It is common practice to apply the toner-carrier mixture to the surface carrying the electrostatic charge image by means of a developing unit wherein toner and magnetizable carrier particles are mixed and a layer of the toner-carrier mixture, referred to herein as "developer", is picked up by an applicator such as a rotating sleeve or drum having magnets inside, forming a so-called magnetic brush on a "magnetic roller".

In one type of development unit toner particles are mixed with larger magnetizable carrier particles, to which the toner particles adhere by electrostatic attraction force. The electrostatic charge of the toner and carrier particles is obtained triboelectrically by agitation. The charge sign of the toner particles is opposite to the charge sign of the carrier particles.

On rotating the magnetic roller, the toner particles still adhering to the magnetically attracted carrier particles are brought into a developing zone wherein the toner particles are separated from the carrier particles by the electrostatic attraction forces of the electrostatic latent image to be developed and transfer to the latent electrostatic charge image. The sign of the toner particles, compared with the sign of the charge on the image forming member, determines whether the development is a "direct" or "reversed" development. If the toner and the image forming member have opposite signs, the development is direct; toner particles will be attracted to the charged areas of the image forming member. If the toner and the image forming member have the same sign, the development is "reverse"; toner particles will be attracted to the discharged areas of the image forming member.

A DC developing bias potential of suitable value is applied between the magnetic brush and the base of the belt. The sign of the DC bias potential is the same as that of the base of the belt. The value of the DC bias potential is typically between the value of the potential of the image areas and that of the non-image areas.

Toner particles are attracted to the electrostatic image on the belt to thereby form a toner image. Subsequently the belt, carrying the toner image, comes into contact with a substrate, for example paper in sheet or web form, to which the toner image is transferred. Alternatively, the transfer of the toner image from the belt to the substrate may be by way of one or more intermediate transfer members.

In order to achieve a homogeneous density on the final print, it is necessary that a consistent homogeneous development nip between the image carrying surface and the magnetic roller be established over the total width of the image. While this is readily achieved with drum photoconductors, due to the rigidity of the drum and the magnetic roller, this is more difficult in the case of a belt. Usually the belt is caused to pass over a backing member, such as a backing roller or sliding shoe, in the vicinity of the developing unit. However, the dynamic stability is still less than in the case of a drum photoconductor due to the limited wrapping angle around the backing member and due to the limited mechanical tension in the belt.

When the apparatus is operated in non-ideal conditions, such that the tension, T, on the moving belt (N/mm), the modulus of elasticity, E, of the belt base $(N/mm)^2$, the belt thickness, d (mm), and the angle, $\alpha$, of contact between the belt and the backing member are such that $$\frac{T \times \sin(\alpha/2) \times 10^3}{E \times d^3} < 1.25$$

a consistent homogeneous development nip between the image carrying surface and the magnetic roller cannot be established and poor results in terms of the uniformity of the print density will be obtained.

In multi-color imaging systems, where a number of developing units are positioned around the path of an electrostatic image carrying belt, it is desirable to run the belt at a high speed, in order to obtain a throughput comparable with mono-chrome systems. Furthermore, in order to reduce the total length of the belt, and the overall size, weight and cost of the apparatus, it is necessary to use developing units in which the magnetic rollers have a relatively low diameter. However, we have found that poor results in terms of image density and image quality can be obtained when the apparatus is operated in non-ideal conditions such that the speed, $v_p$, of the moving belt (mm), and the diameter, $d_{MR}$, of the magnetic roller (mm) are such that $$\frac{V_p}{d_{MR}} > 10.$$

SUMMARY OF THE INVENTION

We have now found that the aforementioned disadvantages are overcome when the development is carried out under the influence of an alternating electrical field between the magnetic roller and the belt base, the peak-to-peak voltage, $V_{pp}$, of which is greater than 800 volts.

Thus, according to a first aspect of the invention there is provided a method of using an image forming apparatus in which an electrostatic image is formed on a moving tensioned belt and is developed by passing the belt over a backing member in the vicinity of a toner development unit which includes a magnetic roller, the belt comprising an electrically conductive base having a non-conductive image-carrying surface layer, wherein the tension, T, on the moving belt (N/mm), the modulus of elasticity, E, of the belt base $(N/mm^2)$, the belt thickness, d (mm), and the angle, $\alpha$, of contact between the belt and the backing member such that $$\frac{T \times \sin(\alpha/2) \times 10^3}{E \times d^3} < 1.25$$

characterized in that the development is carried out under the influence of an alternating electrical field between the magnetic roller and the belt base, the peak-to-peak voltage, $V_{pp}$, of which is greater than 800 volts.

According to a second aspect of the invention, there is provided a method of using an image forming apparatus in which an electrostatic image is formed on a moving tensioned belt comprising an electrically conductive base having a non-conductive image-carrying surface layer, wherein said electrostatic image is developed by passing the belt over a backing member in the vicinity of a toner development unit which includes a magnetic roller, wherein the speed, $v_p$, of the moving belt (mm), and the diameter, $d_{MR}$ of the magnetic roller (mm) are such that $$\frac{V_p}{d_{MR}} > 10$$

characterized in that the development is carried out under the influence of an alternating electrical field between the magnetic roller and the belt base, the peak-to-peak voltage, $V_{pp}$, of which is greater than 800 volts.

The invention is particularly applicable to multicolor image-forming apparatus. Thus, in the image forming apparatus, a plurality of electrostatic images are formed on the belt and are developed by passing the belt through a plurality of toner development stations. Each of the stations includes a development unit including a magnetic roller and a backing member, in opposed position to the magnetic roller, over which the belt passes. At each developing unit, the development is carried out under the influence of an alternating electrical field between said magnetic roller and said belt, the peak-to-peak voltage, $V_{pp}$, of which is greater than 800 volts.

The invention enables acceptable results to be obtained in an apparatus using an image forming member in the form of a belt, when such apparatus is used under non-ideal conditions.

AC development of electrostatic images on a belt is not unknown. An example of an image forming apparatus using AC development is shown in U.S. Pat. No. 5,314,774 (Hewlett Packard) which describes a method and apparatus for developing and printing color images on a moving photoconductive belt. A number of developing devices are spaced from the belt and are AC and DC biased to project toner onto the belt. The composite color image thereby formed on the belt is then transferred to an intermediate belt and from there to a final substrate. A relationship is disclosed defining the motion of toner particles in the air gap between the developer carrying member in the developing device, and the belt in terms of the size of the toner particles, the viscosity of the air gap, the charge on the toner and the DC and AC electrostatic fields.

AC development has a number of advantages. The sensitivity to density and image quality variations due to variations in distance between the photoconductor and the magnetic roller, is reduced. This results in a better uniformity of both image density and image quality over the total page. Higher toner amounts can be transferred towards the photoconductor during AC development than can be achieved with DC-only development, resulting in higher print densities on the image. Using an AC electric field during development reduces the development time constant considerably, resulting in a better development of image areas containing a sharp transition from a high density to a low density or vice versa. The result is an image with sharper well-defined image edges. The image density developed with AC development is less sensitive to variations in developer supply on the magnetic roller. Furthermore, AC development leads to images with less blow-off and a better uniformity of line widths.

Especially in the non-ideal conditions using a belt image forming member as described by:

$$\frac{T \times \sin(\alpha/2) \times 10^3}{E \times d^3} > 1.25$$

and $$\frac{V_p}{d_{MR}} > 10$$

the advantages of AC development over normal DC development can result in a better and more acceptable image quality in terms of image density, uniformity of image density and rendition of sharp image transitions.

The image forming belt may be in the form of a charge carrying belt onto which charge images are deposited by ion-deposition or, more preferably, in the form of a photoconductive belt. The photoconductive belt may comprise a base layer of a polymer material of 60 to 200 $\mu$m thickness covered with a thin conductive layer as a back electrode (preferably 0.05 to 1 $\mu$m thickness).

The tension, T, on the moving belt may be from 0.005 to 15, such as about 0.1N/mm.

The modulus of elasticity, E, of the belt base may be from 2000 to 6000, such as about 4000N/mm$^2$.

The belt thickness, d, may be from 0.05 to 1.5, such as 0.1 mm.

If the overall thickness of the belt is too high, the belt may be insufficiently flexible to closely follow the circumference of guide rollers and may become subject to deformation on standing. One or more layers of an inorganic photoconductor, or more preferably an organic photoconductor, are positioned on top of the conductive layer with a total thickness of, for example, from 10 to 20 $\mu$m. To make contact with the back electrode, the belt has at least one strip of conductive material positioned beyond the image area and extending through the photoconductive layer. Conductive grounding brushes may be provided to contact this conductive strip.

Tension in the belt may be established by any means known to those skilled in the art and preferably lies between 0.005 and 15N/mm, more preferably between 0.05 and 0.3N/mm.

The developer which is used in the method according to the invention preferably comprises toner particles containing a mixture of a resin, a dye or pigment of the appropriate color and normally a charge-controlling compound giving triboelectric charge to the toner. In dual-component developers which are normally used, carrier particles are also present for charging the toner particles by frictional contact therewith. The carrier particles may be made of a magnetizable material, such as iron or iron oxide. Developing technologies other than magnetic brush development, such as mono-component developers, can be used.

Dry-development toners essentially comprise a thermoplastic binder consisting of a thermoplastic resin or mixture of resins including coloring matter, e.g. carbon black or coloring material such as finely dispersed pigments or dyes.

The mean diameter of dry toner particles for use in magnetic brush development is conventionally about 10 $\mu$m (ref. "Principles of Non Impact Printing" by Jerome L. Johnson—Palatino Press Irvine, Calif., 92715 U.S.A. (1986), p. 64–85). For high resolution development, the mean diameter may be from 1 to 5 $\mu$m (see e.g. British patent specification GB-A-2180948 and International patent specification WO-A-91/00548). However, in the present invention, the toner particle size may be from 5 to 15 $\mu$m, most preferably between 7 and 12 $\mu$m.

The toner particles contain in the resinous binder one or more colorants (dissolved dye or dispersed pigment) which may be white or black or has a color of the visible spectrum, not excluding however the presence of infra-red or ultra-violet absorbing substances.

The thermoplastic resinous binder may be formed of polyester, polyethylene, polystyrene and copolymers thereof, e.g. styrene-acrylic resin, styrene-butadiene resin, acrylate and methacrylate resins, polyvinyl chloride resin, vinyl acetate resin, copoly(vinyl chloride-vinyl acetate) resin, copoly(vinyl chloride-vinyl acetate-maleic acid) resin, vinyl butyral resins, polyvinyl alcohol resins, polyurethane resins, polyimide resins, polyamide resins and polyester resins. Polyester resins are preferred for providing high gloss and improved abrasion resistance. The volume resistivity of the resins is preferably at least $10^{13}$ Ω-cm.

We prefer to use toners having a composition comprising a thermoplastic binder together with from 10% to 50% by weight of a pigment, based on the weight of the toner composition. The use of toner compositions having a higher level of pigment therein enables images with a higher density to be printed. Alternatively, for the same image density, smaller toner particles can then be used.

The charge on the toner particles generated usually by an agitator in the developing unit, preferably lies between 5 and 25 $\mu$C/g, most preferably from 10 to 20 $\mu$C/g.

The magnetic roller typically comprises a shell and a magnetic core. The shell may be formed of a rigid metal, such as steel or aluminum. The shell preferably has a rough surface in order to provide good developer transport. A surface roughness of from 0.5 to 10 $\mu$m is preferred. Grooves may be provided in the surface of the shell for the same purpose.

Any suitable known magnetic material may be used for the core of the magnetic roller, including iso-Ba ferrite, aniso-Sr ferrite, aniso-plastic, iso-rubber and aniso-rubber magnetic materials. The core may be constructed by providing long rods of permanent magnets mounted within a yoke inside the shell, with one permanent magnet per pole. Typically 3 or 4 poles are used over the total circumference of the roller. Alternatively, the core is formed of one block of permanent magnetic material, for example by injection molding, which is simultaneously magnetized in multiple poles. From 4 to 10 poles can be provided over the circumference of the roller by this method.

The magnetic roller typically has a diameter of from 10 to 100 mm, most preferably from 20 to 60 mm. Pole strengths are typically from 500 to 1500 gauss, such as from 600 to 1000 gauss.

The magnetic brush, from which toner particles are removed during each revolution, to be taken up by the developed electrostatic charge image, has to be supplied with fresh toner-carrier mixture. This is normally done by an agitator projecting or scooping up toner-carrier mixture onto the magnetic roller from a housing for holding the developer. The partly exhausted developer is returned to the bulk of developer contained in the housing and has to be thoroughly mixed timely with freshly added toner to keep the toner-carrier weight ratio within acceptable limits for obtaining consistent development results.

Preferably, the applicator comprises a rotatable developing sleeve having magnets located therein for attracting developer onto the sleeve.

From the above conclusions, it follows that the AC peak-to-peak voltage $V_{AC}$ is greater than 800 volts. The AC peak-to-peak voltage $V_{AC}$ is preferably 1000 and 3000 volts. If the AC peak-to-peak voltage is too high, high bias currents are needed, charge breakdown may occur and carrier loss may result.

The speed of the image forming belt $v_p$ preferably lies between 50 and 500, most preferably between 125 and 300 mm/s. If the belt speed is too high, development can be insufficient unless more than one magnetic roller is used. If the belt speed is too slow, the engine will have an undesirable low throughput.

Preferably, other variables in the process are selected as set forth below.

The cleaning potential $V_{c1}$, that is the absolute value of the difference between the potential of the non-image areas and the DC bias potential, preferably lies between 20 and 250 volts, most preferably between 100 and 150 volts. The main effect of this cleaning potential is to establish an electric field between the magnetic roller and the image forming member at the non-image areas which repulses the toner particles away from the image forming member back to the magnetic brush. If the cleaning potential is too high, carrier particles may be attracted to the belt resulting in carrier loss and/or breakdown. If the cleaning potential is too low, the non-image areas will be soiled by background development.

The development potential $V_{DEV}$, that is the absolute value of the difference between the potential of the image areas and the DC bias potential, preferably lies between 50 and 500 volts, most preferably between 150 and 350 volts. The main effect of this development potential is to establish an electric field between the magnetic roller and the image forming member at the image areas which attracts the toner particles to the image areas. If the development potential is too high, too many toner particles will be developed resulting in a too high image density and in excessive toner consumption. If the development potential is too low, insufficient development takes place.

The absolute value of the dark potential $V_0$ preferably lies between 200 and 800 volts, most preferably between 300 and 500 volts. If the absolute value of the dark potential is too high, charge breakdown may occur. If the absolute value of the dark potential is too low, the development and cleaning potentials may be insufficient.

The preferable ranges for the DC bias potential $V_{DC}$ and the potential after exposure, $V_e$, are defined by the preferred ranges for the cleaning potential $V_{c1}$, the development potential VDEV and the dark potential $V_0$, since the following relations hold:

for reverse development:

$$V_{DEV} = |V_{DC} - V_e|$$

$$V_{Cl} = |V_0 - V_{DC}|$$

for direct development:

$$V_{DEV} = |V_0 - V_{DC}|$$

$$V_{Cl} = |V_{DC} - V_e|$$

The AC bias frequency f preferably lies between 1 and 8 kHz, most preferably between 2 and 6 kHz. If the AC bias frequency is too high, high bias currents are needed. Moreover, the advantages of AC development will be lost because the toner particles stop being influenced by the AC electric field because acceleration forces acting on the toner particles will become too high. If the AC bias frequency is too low, the toner particles will be able to follow each individual AC bias pulsation resulting in a rippling effect in the developed image.

The apparatus may be in the form of a multi-color duplex printer of the type comprising two image forming stations positioned one on either side of a substrate path. Sheets to be printed, preferably removed from a stack located within a housing of the apparatus, are fed along the path into operational positions relative to the two image-forming stations where toner images are transferred thereto and then to a fuser station where the toner images are fixed.

The removed sheet may be fed through an alignment station which ensures the longitudinal and lateral alignment of the sheet, prior to its start from said station under the control of the imaging system. As the sheet leaves the alignment station, it preferably follows a straight horizontal path through the printer. The speed of the sheet, along the path, may be determined by a driven pressure roller pair.

A buffer station may be positioned between the second image forming station and the fuser station, allowing the speed of the sheet to decrease to enable the speed of fuser to be lower than the speed of image formation. Each image forming station comprises an endless image forming belt guided, for example, over a plurality of idler guide rollers to follow a path to advance successive portions of the image forming surface sequentially through various processing stations disposed along the path of movement thereof. The image forming surface of the belt is ideally positioned at the outside of its loop. Drive means are provided for driving the belt, preferably at a uniform speed and for controlling its lateral position. The drive means for the belt may comprise one or more drive rollers, driven by a controlled drive motor, to ensure a constant drive speed.

In a preferred embodiment, a portion of photoconductive belt passes through a charging station which charges the belt to a substantially uniform potential. Next, the belt passes to an exposure station which exposes the photoconductive belt to successively record four latent color separation images. The latent images are developed for example with magenta, cyan, yellow and black developer material, respectively. These developed images are transferred to the print sheet in superimposed registration with one another to form a multicolor image on the sheet. After an electrostatic latent image has been recorded on the image forming belt, the belt advances this image to a development station which includes four individual developer units. Each developer unit may be of the type generally referred to in the art as "magnetic brush development units". Typically, a magnetic brush development system employs a magnetizable developer material including magnetic carrier granules having toner particles adhering triboelectrically thereto. The developer material is continuously brought through a directional flux field to form a brush of developer material. The developer particles are continuously moving so as to provide the brush consistently with fresh developer material. Development is achieved by bringing the brush of developer material into contact with the image forming surface. The developer units respectively apply toner particles of a specific color which corresponds to the compliment of the specific color-separated electrostatic latent image recorded on the image forming surface. The color of each of the toner particles is adapted to absorb light within a preselected spectral region of the electromagnetic wave spectrum. Each of the developer units is moved into and out of an operative position. In the operative position, the magnetic brush is closely adjacent to the image forming belt, whereas in the non-operative position, the magnetic brush is spaced therefrom. During development of each electrostatic latent image only one developer unit is in the operative position, the remaining developer units being in their non-operative one. This ensures that each electrostatic latent image is developed with toner particles of the appropriate color without inter-mingling. Each development unit includes a magnetic roller. The moving image forming belt moves close to, but not in contact with, the magnetic roller. The backing member may be a stationary or a moving member. For example, the backing member may be a fixed backing shoe or a rotatable backing roller of accurately uniform diameter. The angle, $\alpha$, of contact between the belt and the backing member may be from 0° to 200°. The controlled DC+AC potential is applied between the magnetic roller and the back electrode of the image forming surface of the belt. After their development, the images are moved to toner image transfer stations where they are transferred on a sheet of support material. At each transfer station, the sheet follows the path into contact with the image forming belt. The sheet is advanced in synchronism with the movement of the belt. After transfer of the four toner images, the belt is cleaned in a cleaning station. Thereafter, a lamp illuminates the belt to remove any residual charge remaining thereon prior to the start of the next cycle. The timing of exposure of the four distinct images, the relative position of these images on the image forming belt and the lengths of the path of this belt between the successive transfer stations are such that as a sheet follows the path through these stations, the partly simultaneous transfer of the distinct toner images to the paper sheet is such that a perfect registering of these images is obtained. The buffer station may be provided with an endless transport belt which transports the sheet bearing the color images to the fuser station. The fuser station operates to melt the toner particles transferred to the sheets in order to affix them. This operation requires a certain minimum time since the temperature of the fuser is subject to an upper limit which must not be exceeded. Otherwise the lifetime of the fuser roller becomes unsatisfactory. For this reason, the speed of the fuser station may be limited. It is advantageous to use a high speed of image formation and image transfer, since the four color separations of each color image are recorded by exposure station in succession, which means that the recording time of one color image amounts to at least four times the recording time of one color component. Therefore, a relatively high speed of the image forming belt is required, and thus of the synchronously moving sheets, as compared with a maximum usable traveling speed through the fuser station. Furthermore, it may be desirable to adjust the fusing speed independently of the image processing speed, i.e. the belt speed, for obtaining optimum results. It should be noted that the image processing speed in the imaging stations is preferably constant. The length of the buffer station should be sufficient for receiving the largest sheet size to be processed in the apparatus. The buffer station operates initially at the speed of the image forming belts of image forming stations. The speed of this station is reduced to the processing speed of the fuser station as the trailing edge of the sheet leaves the second image forming station. The fusing station can be of known construction, and can be arranged for radiation or flash fusing, for fusing by convection and/or by pressure, etc. Hot roller fusing is preferred.

One image-forming station need not necessarily operate with one exposure station but may include more than one exposure station, each such station co-operating with several developer units. The printing apparatus of the present invention is not limited to color reproduction but may also be a mono-chrome printer, even a multi-station monochrome printer.

In addition to U.S. Pat. No. 5,314,774 (Hewlett Packard) referred to above, we are aware of Japanese patent publication JP 60164778 (Matsushita Electric Ind Co Ltd), which describes an electrophotographic copying machine in which a photosensitive belt is charged, the charged surface is exposed to form a charged image, the image is developed by a developing unit where the belt passes over a backing member which serves to define the distance between the belt and the developer carrier of the developing unit. European patent specification EP 424137-A (Konica Corporation) describes a color image forming apparatus using a photosensitive belt. Space retaining members serve to define the distance between the belt and the developing sleeves of developing devices. European patent specification EP 625734 (Eastman Kodak Company) describes the development of an electrostatic image using a two component developer, using AC development. AC development is said to loosen the carrier of the developer from the image member, facilitating it being attracted back to the shell of the magnetic roller. U.S. Pat. No. 5,652,648 (Behe et al./Xerox Corporation) describes a negative wrap back-up roll over which a photoconductive belt passes adjacent a developing unit. International patent specification WO 98/07073 (Agfa-Gevaert NV) describes an electrostatic color printing apparatus for forming successive electrostatic color part images on a recording member by use of an endless photosensitive belt which moves past a number of developing stations for sequentially developing latent images on the belt. European patent specification EP 871074 (Xerox Corporation), published Oct. 14, 1998, describes a developer backer bar that allows axial misalignment between the backer bar and a developer donor roll. The printing apparatus is not limited to duplex printing but may also be a single-side printer.

BRIEF DESCRIPTION OF THE DRAWING

The invention will be described in further detail, purely by way of example, with reference to the accompanying drawings, in which.

DETAILED DESCRIPTION

Figure 1:
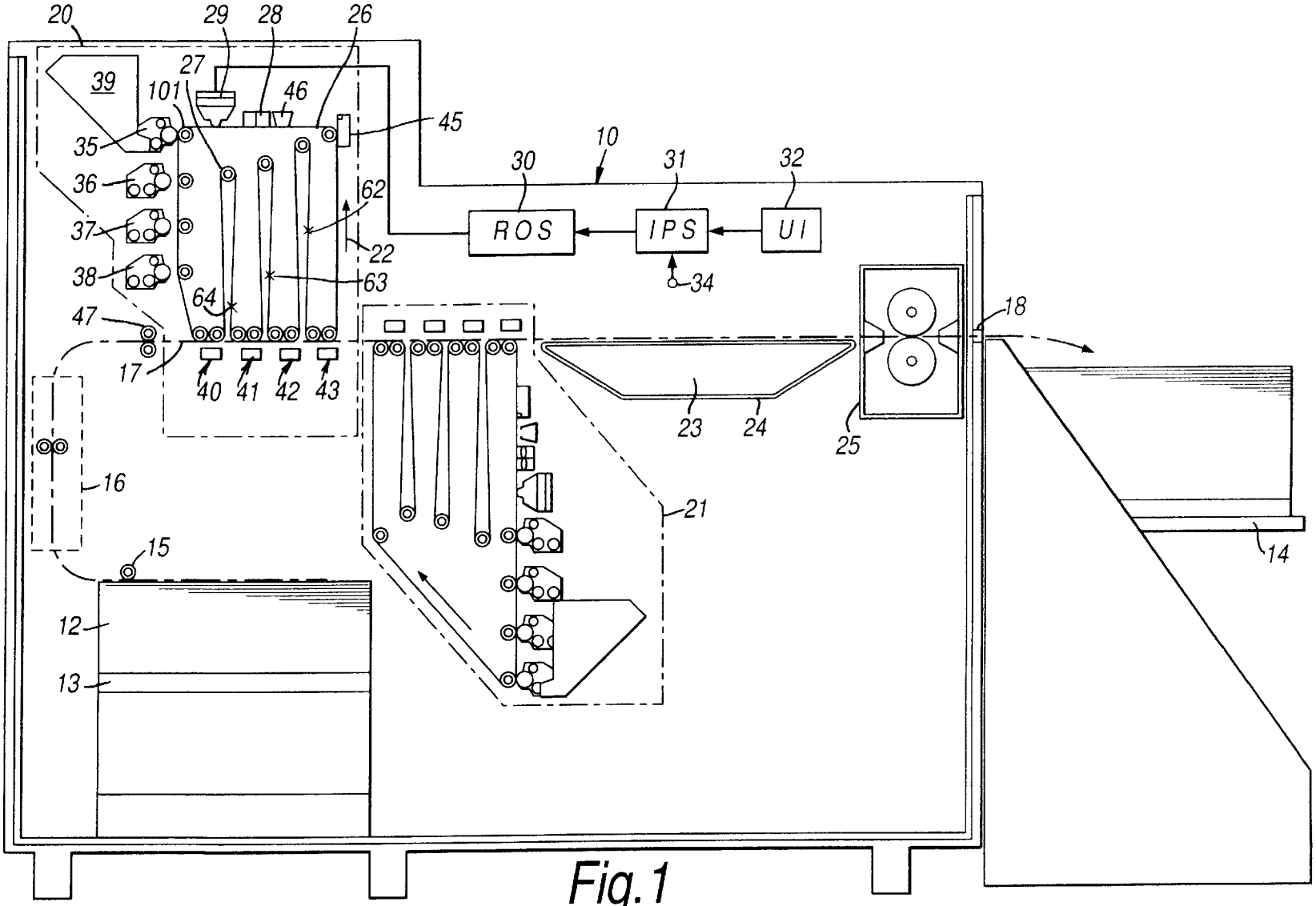
FIG. 1 is a diagrammatic representation of one embodiment of an electrophotographic duplex color printer.

FIG. 1 shows a diagrammatic representation of one embodiment of an electrophotographic duplex color printer.

The printer comprises a light-tight housing 10 which has at its inside a stack 12 of sheets to be printed and loaded on a platform 13. The height of this platform 13 is adjusted in accordance with the size of the stack 12. At its output the printer has a platform 14 onto which the printed sheets are received.

A sheet to be printed is removed from stack 12 by a dispensing mechanism 15 of known construction for removing the top sheet from stack 12.

The removed sheet is fed through an alignment station 16 which ensures the longitudinal and lateral alignment of the sheet, prior to its start from said station under the control of the imaging system. As the sheet leaves the alignment station, it follows a straight horizontal path 17 up to output section 18 of the printer. The speed of the sheet, upon entering said path, is determined by driven pressure roller pair 47, driven by a stepper motor, the frequency of which is adjustable with an accuracy of a piezo crystal (i.e. better than $10^{-6}$).

A number of processing stations are located along the path 17. A first image-forming station 20 indicated in a dash-and-dot line is provided for applying a multicolor image to the obverse side of the sheet and is followed by a second station 21 for applying a multicolor image to the reverse sheet side. A buffer station 23 then follows, with an endless transport belt 24 for transporting the sheet to a fuser station 25 while allowing the speed of the sheet to decrease because the speed of fuser 25 is lower than the speed of image formation. Both image forming stations 20 and 21 being similar to each other, only station 20 will be described in more detail hereinafter. An endless photoconductor belt 26 is guided over a plurality of idler rollers 27 to follow a path in the direction of arrow 22 to advance successive portions of the photoconductive surface 59 sequentially through the various processing stations disposed about the path of movement thereof. The photoconductor belt 26 is driven by a drive rollers 101, driven with a DC-motor with encoder feedback, the motor being coupled to the drive roller 101 over a two-step reduction with a total reduction of 1/25. The driving speed is kept constant by measuring the belt revolution time and adjusting the speed so that the belt revolution time is constant. In this manner a belt speed accuracy of $10^{-4}$ can be achieved.

Figure 2:
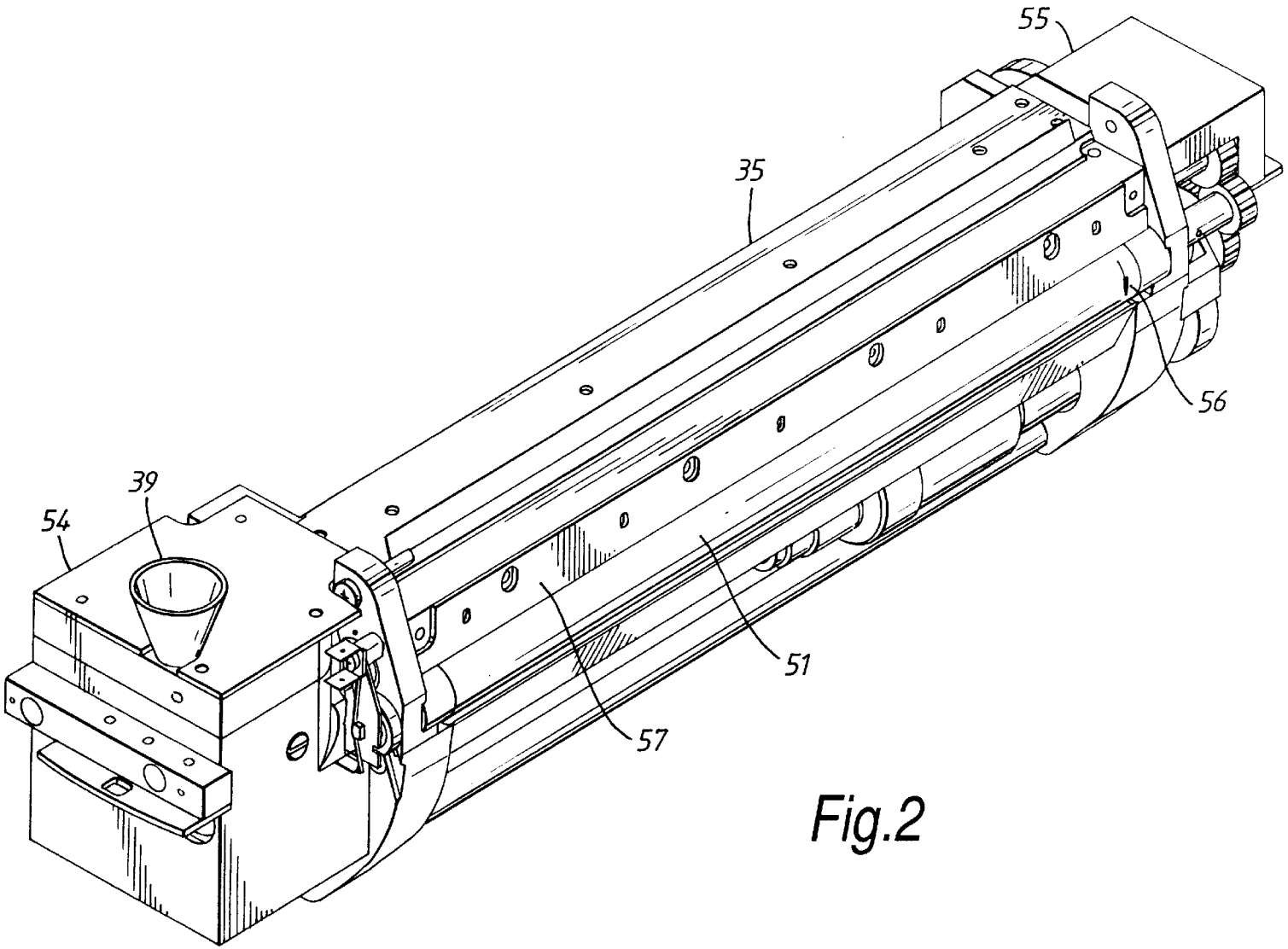
FIG. 2 is an isometric view of one embodiment of a development unit of the printer shown in FIG. 1.
Figure 3:
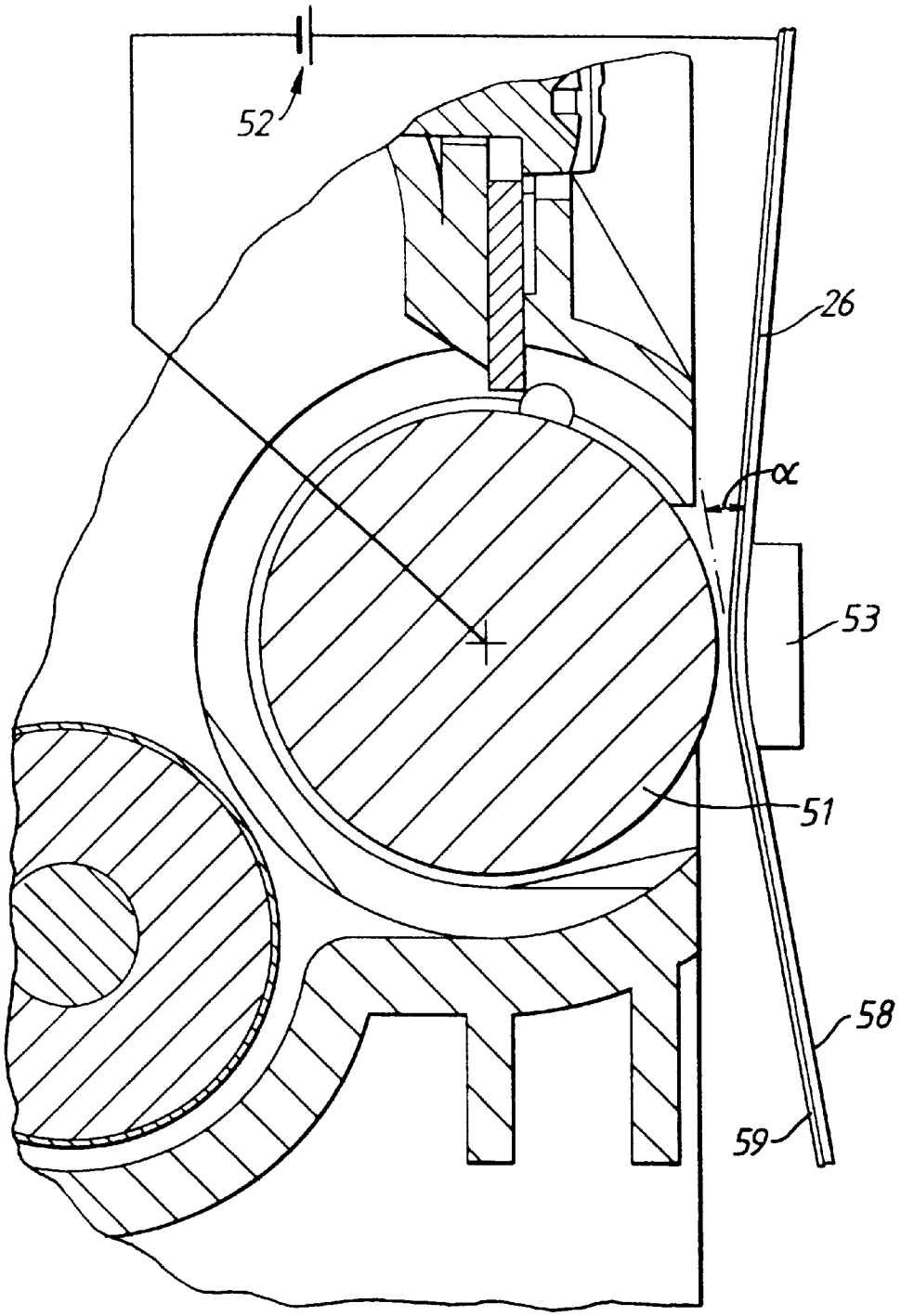
FIG. 3 shows detail from part of the development unit shown in FIG. 2.

Means (not shown) are provided controlling the lateral position of the photoconductive belt 26. Initially, a portion of photoconductive belt 26 passes through charging station 28. At the charging station, a corona-generating device electrostatically charges the belt to a relatively high, substantially uniform potential, the dark potential $V_0$. Next, the belt passes to an exposure station 29. The exposure station includes a raster output scanner (ROS) 30 including a laser with a rotating polygonal mirror block which creates the output printing image by laying out the image in a series of horizontal scan lines. Exposure station 29 will expose the photoconductive belt to successively record four latent color separation images. The latent images are developed for example with magenta, cyan, yellow and black developer material, respectively. These developed images are transferred to the print sheet in superimposed registration with one another to form a multicolor image on the sheet. The ROS receives its input signal from an image processing system (IPS) 31. This system is an electronic control device which prepares and manages the data inflow to the scanner 30. A user interface (UI) 32 is in communication with the IPS and enables the operator to control various operator-adjustable functions. IPS 31 receives its signal from input 34. This input can be the output of a raster input scanner (RIS), in which case the apparatus is a so-called intelligent copier. In such case, the apparatus contains document illumination lamps, optics, a mechanical scanning drive, and a charge-coupled device. The RIS captures the entire original document and converts it to a series of raster scan lines and measures a set of primary color densities, i.e. red, green and blue densities at each point of the original document. However, input 34 can as well receive an image signal resulting from an operator operating an image processing station. After an electrostatic latent image has been recorded on the photoconductive belt 26, the belt 26 advances this image to the development station. This station includes four individual developer units 35, 36, 37 and 38. The developer units are of a type generally referred to in the art as "magnetic brush development units". Developer units 35, 36 and 37, respectively, apply toner particles of a specific color which corresponds to the compliment of the specific color-separated electrostatic latent image recorded on the photoconductive surface 59. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 26, while the green areas will be reduced to a voltage level ineffective for development. The charged areas are then made visible by having developer unit 35 apply green absorbing (magenta) toner particles onto the electrostatic latent image recorded on photoconductive belt 26. Similarly, a blue separation is developed by developer unit 36 with blue absorbing (yellow) toner particles, while the red separation is developed by developer unit 37 with red absorbing (cyan) toner particles. Developer unit 38 contains black toner particles and may be used to develop the electrostatic latent image formed from black information or text, or to supplement the color developments. Each of the developer units is moved into and out of an operative position. In the operative position, the magnetic brush is closely adjacent to the photoconductive belt, whereas in the non-operative position, the magnetic brush is spaced therefrom. During development of each electrostatic latent image only one developer unit is in the operative position, the remaining developer units being in their non-operative one. This ensures that each electrostatic latent image is developed with toner particles of the appropriate color without inter-mingling. In FIG. 1, developer unit 35 is shown in its operative position. Finally, each unit comprises a toner hopper, such as hopper 39 shown for unit 35, for supplying fresh toner to the developer which becomes progressively depleted by the development of the electrostatic charge images. Referring to FIG. 2, there is shown one of the developing units, namely unit 35 which on its front side has a magnetic roller 51 consisting of a non-ferromagnetic sleeve rotatable around a magnet arrangement and slightly protruding from the unit for applying a layer of developer adhering in the form of a brush to its outer surface to the photoconductive surface 59 of the belt 26. The developing unit 35 is supplied with magnetizable development material including magnetic carrier granules having toner particles adhering triboelectrically thereto. The developer material is continually brought through a directional flux field to form a brush of developer material. The developer materials are continuously moving so as to provide the brush consistently with developer material. The left hand part of FIG. 2 shows a mixer arrangement 54 with a toner hopper 39, whereas the right hand part is the driving mechanism 55 with inter-engaging gears for the driving of the rotatable rollers of the unit 35. Magnetic roller 51 rotates in the direction of the arrow 56 and the thickness of the layer of developer supplied to its surface is metered by an adjustable doctor blade 57. The representation of the toner hopper 39 is diagrammatic only, and it will be understood that in practice the toner addition system will comprise a toner cartridge or bottle suitably and removably connected to the unit, and a metering system for feeding controlled amounts of toner to the unit 35. Part of the development unit 35 is shown in cross-section in more detail in FIG. 3. As will be seen in this Figure, the development unit includes a magnetic roller 51. The moving photoconductive belt 26, moves close to, but not in contact with, the magnetic roller 51. The photoconductive belt may comprise a base layer 58 of polyethyleneterephthalate of 100 $\mu$m thickness covered with a thin layer of aluminum as a back electrode (less than 0.5 $\mu$m thickness). The organic photoconductor (OPC) layer is on top of the aluminum layer and is from 15 $\mu$m in thickness. To make contact with the aluminum back electrode, the photoconductor has two strips of carbon/polymer mixture, with a width of 10 mm, positioned beyond the image area and extending through the OPC layer. Conductive grounding brushes (not shown) contact these carbon strips. The belt is arranged such that the photoconductive layer is positioned on the outside of the belt loop. The distance between the photoconductive surface 59 of the belt 26 and the magnetic roller 51 is constant and is determined by a fixed sliding backing shoe 53. A controlled DC+AC potential is applied between the magnetic roller and the back electrode of the photoconductive surface 59 of the belt 26 via contact brushes (not shown) by a control device generally represented at 52. The angle of contact between the belt 26 and the backing shoe 53 is indicated in FIG. 3 as reference $\alpha$. When all development units are placed in one line as in the embodiment shown in FIG. 1, the angle $\alpha$ is typically between 2° and 6°. After their development, the toner images are moved to toner image transfer stations 40, 41, 42 and 43 where they are transferred on a sheet of support material, such as plain paper or a transparent film. At a transfer station, a sheet follows the rectilinear path 17 into contact with photoconductive belt 26. The sheet is advanced in synchronism with the movement of the belt. After transfer of the four toner images, the belt following an upward course is cleaned in a cleaning station 45 where a rotatable fibrous brush or the like is maintained in contact with the photoconductive belt 26 to remove residual toner particles remaining after the transfer operation. Thereafter, lamp 46 illuminates the belt to remove any residual charge remaining thereon prior to the start of the next cycle. The operation of the printer described hereinbefore is as follows. The magenta latent image being exposed by station 29 on photoconductive belt 26, this image is progressively developed by station 35 being in its operative position as the belt moves therethrough. Upon completion of the exposure of the magenta image, the yellow image becomes exposed. During the yellow exposure, the developed magenta image is transported past inactive stations 36, 37 and 38 while toner transfer stations 40 to 43 are also still inoperative. As the development of the magenta latent image is finished, magenta development station 35 is withdrawn to its inoperative position and after the trailing edge of the magenta image has passed yellow development station 36, this station is put into the operative position to start the development of the yellow latent image. While the latter portion of the yellow latent image is being developed, the exposure of the cyan latent image at 29 starts already. The described processes of image-wise exposure and color development continue until the four color separation images have been formed in successive spaced relationship on the photoconductive belt. A sheet which has been taken from stack 12 and kept in readiness in aligner 16, is then advanced and reaches toner transfer station 40 where at that moment the last formed toner image, viz. the black one, is ready to enter the station. Thus, the lastly formed toner image is the first to become transferred to a sheet. The firstly formed toner image, viz. the magenta one, takes with its leading edge a position on the belt as indicated by the cross 62 and will thus be transferred last. The other two toner images take positions with their leading edges as indicated by crosses 63 and 64, respectively. Thus, the timing of exposure of the four distinct images, the relative position of these images on the photoconductive belt and the lengths of the path of this belt between the successive transfer stations are such that as a paper sheet follows a linear path through these stations, the partly simultaneous transfer of the distinct toner images to the paper sheet is such that a perfect registering of these images is obtained. The sheet bearing a color toner image on its obverse side produced as described hereinbefore, is now passed through image forming station 21 for applying a color toner image to the reverse side of the sheet. The buffer station 23 with an endless belt 24 transports the sheet bearing the color images to the fuser station 25. The buffer station 23 allows the speed of the sheet to change, thereby enabling the speed of fuser station 25 to be different from that of the speed of image forming stations 20, 21. In the apparatus according to the present embodiment, the speed of the two photoconductive belts may be, for example, 125 or 250 mm/s, whereas the fusing speed was 100 mm/s or less. The length of buffer station 23 is sufficient for receiving the largest sheet size to be processed in the apparatus. Buffer station 23 operates initially at the speed of the photoconductive belts of image forming stations 20 and 21. The speed of this station is reduced to the processing speed of fuser station 25 as the trailing edge of the sheet leaves the second image forming station 21.

Figure 4:
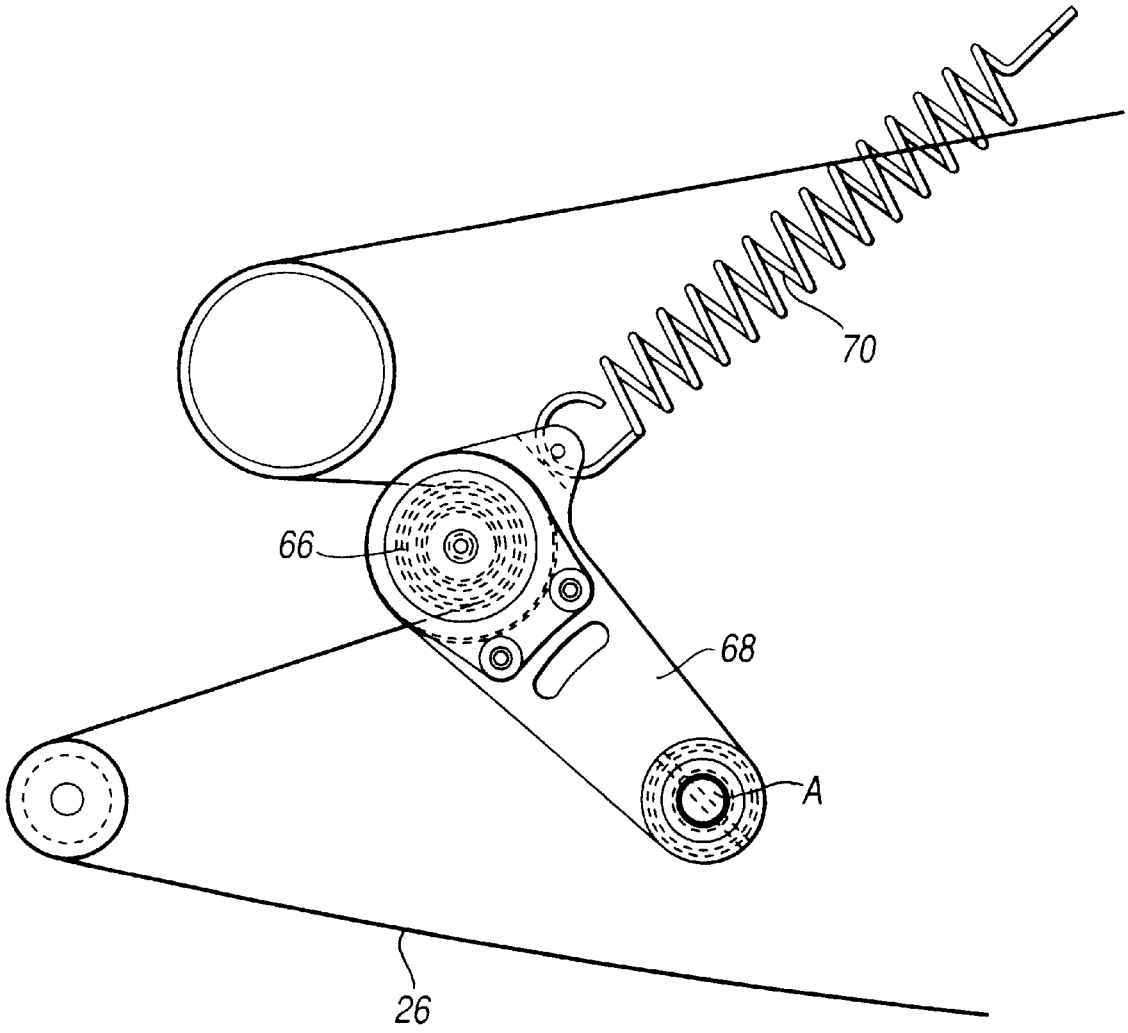
FIG. 4 shows detail from another part of the development unit shown in FIG. 2.

The fuser station 25 operates to melt the toner particles transferred to the sheets in order to affix them. The fusing station 25 can be of known construction, and can be arranged for radiation or flash fusing, for fusing by convection and/or by pressure, etc. Hot fusing is preferred. The fused sheet is finally received on platform 14. Tension in the belt may be established, for example, as shown in FIG. 4. Here, the photoconductor belt 26 is placed under tension by a tensioning roller 66 which is mounted on an arm 68, which in turn can rotate around point A. The tensioning roller 66 is pulled in one direction by the belt 26 and in the other direction by a spring 70.

EXAMPLES

Example 1

In this example, reversal development is used. A photoconductive belt was charged to a dark potential of between 370 and 500 volts before being exposed image-wise to create a charge image thereon. The base 58 of the belt had a modulus of elasticity of 4000N/mm$^2$. The belt had a thickness of 0.1 mm and a width of 430 mm. The belt was moved at a speed of 250 mm/sec, with a tension of 40N, applied over the width of the belt past a development unit loaded with commercially available DCP-1 developer containing 4.2% toner (ex Xeikon NV). The development unit included a magnetic roller having a diameter of 20 mm, rotating at a circumferential speed which was twice that of the linear belt speed. The magnetic roller was spaced at a distance of 0.65±0.05 mm from the belt surface 59 providing a development angle of 4°. The magnetic pole strength of the development pole was 950±50 Gauss. Developer was supplied to the magnetic roller at between 65 and 80 mg/cm$^2$.

In this example, $$\frac{T \times \sin(\alpha/2) \times 10^3}{E \times d^3} = \frac{40/430 \times \sin(4/2) \times 10^3}{4000 \times 0.1^3} = 0.81$$

and $$\frac{V_p}{d_{MR}} = \frac{250}{20} = 12.5,$$

conditions which are considered to be non-ideal. According to the invention therefore the development is carried out under the influence of an alternating electrical field applied between the magnetic roller and the belt base 58, the peak-to-peak voltage, $V_{pp}$, of which is greater than 88 volts. After development of the image on the belt, the toner image was transferred directly to a paper sheet substrate and the product was examined for image quality. The following densities were obtained:

| | DC only | DC + AC |
|---|---|---|
| Magenta | 0.50 | 1.39 |
| Cyan | 0.58 | 1.38 |
| Yellow | 0.67 | 1.12 |

DC-bias was in both cases 250 volts. The AC development was carried out with an AC-voltage of 1500 (peak-to-peak) and at a frequency of 6 KHz. Densities were measured with a Gretag (Trade Mark) densitometer, type 19C.

The images made with AC development showed a better density uniformity and a better uniformity of image quality in general and also the rendition of sharp image transitions was remarkably better than in the images made with DC development only.

We claim:

1. A method of using an image forming apparatus in which an electrostatic image is formed on a moving tensioned belt having a belt thickness, d, and a tension, T, and is developed by passing said belt over a backing member adjacent a toner development unit which includes a magnetic roller, with an angle, α, of contact between said belt and said backing member, said belt comprising an electrically conductive base having a modulus of elasticity, E, having a non-conductive image-carrying surface layer, wherein $$\frac{T \times \sin(\alpha/2) \times 10^3}{E \times d^3} < 1.25,$$

wherein an alternating electrical field is applied between said magnetic roller and said belt base, with a peak-to-peak voltage, $V_{pp}$, greater than 800 volts.

2. The method according to claim 1 wherein said tension, T, on said moving belt is from 0.005 to 15N/mm, said modulus of elasticity, E, of said belt is from 2000 to 6000 N/mm$^2$, said belt thickness, d, is from 0.05 to 1.5 mm, said angle, α, of contact between said belt and said backing member is from 2° to 6° and said peak alternating current voltage, $V_{pp}$, is from 1000 to 3000 volts.

3. A method of using an image forming apparatus in which an electrostatic image is formed on a moving tensioned belt having a speed, $v_p$, and is developed by passing said belt over a backing member adjacent a toner development unit which includes a magnetic roller, having a diameter, $d_{MR}$, wherein $$\frac{V_p}{d_{MR}} > 10$$

and wherein an alternating electrical field is applied between said magnetic roller and said belt, with a peak-to-peak voltage, $V_{pp}$, greater than 800 volts.

4. method of using an image forming apparatus in which a plurality of electrostatic imaaes are formed on a moving tensioned belt comprising an electrically conductive base having a non-conductive image-carryina surface layer, wherein said electrostatic images are developed by passing the belt through a plurality of toner development stations, each which Includes a development unit including a magnetic roller having a diameter, $d_{MR}$ and a backing member, in opposed position to said magnetic roller, over which said belt passes and wherein, at each developing unit, said moving belt has a speed, $v_p$, such that $$\frac{V_p}{d_{MR}} > 10$$

and wherein, at each development station, an alternating electrical field is applied between said magnetic roller and said belt, with a peak-to-peak voltage, $V_{pp}$, greater than 800 volts.

5. A method of using an image forming apparatus in which a plurality of electrostatic images are formed on a moving tensioned belt having a thickness, d, a tension, T, and a speed, $v_p$, said belt comprising an electrically conductive base having a modulus of elasticity, E, and a non-conductive image-carrying surface layer, wherein said electrostatic images are developed by passing said belt through a plurality of toner development stations, each which includes a development unit including a magnetic roller having a diameter, $d_{MR}$, and a backing member in opposed position to said magnetic roller, over which said belt passes with an angle, $\alpha$, of contact between said belt and said backing member, wherein, at each developing unit, $$\frac{T \times \sin(\alpha/2) \times 10^3}{E \times d^3} < 1.25,$$

and $$\frac{V_p}{d_{MR}} > 10$$

and wherein, at each development station, an alternating electrical field is applied between said magnetic roller and said belt, with a peak-to-peak voltage, $v_{pp}$, greater than 800 volts.

* * * * *